US008376913B2

(12) United States Patent
Lee et al.

(10) Patent No.: US 8,376,913 B2
(45) Date of Patent: Feb. 19, 2013

(54) EXERCISING DEVICE

(75) Inventors: Sunny Lee, Nan-Tou Hsien (TW); Simon Chao, Nan-Tou Hsien (TW)

(73) Assignee: Superweigh Enterprise Co., Ltd., Nan-Tou Hsien (TW)

( * ) Notice: Subject to any disclaimer, the term of this patent is extended or adjusted under 35 U.S.C. 154(b) by 372 days.

(21) Appl. No.: 12/888,690

(22) Filed: Sep. 23, 2010

(65) Prior Publication Data

US 2012/0077645 A1 Mar. 29, 2012

(51) Int. Cl.
*A63B 22/04* (2006.01)

(52) U.S. Cl. ..... 482/52

(58) Field of Classification Search ..... 482/51–53, 482/57, 62, 70–71, 908; *A63B 22/04*
See application file for complete search history.

(56) References Cited

U.S. PATENT DOCUMENTS

| | | | | |
|---|---|---|---|---|
| 6,024,676 | A * | 2/2000 | Eschenbach | 482/51 |
| 6,168,552 | B1 * | 1/2001 | Eschenbach | 482/52 |
| 6,422,977 | B1 * | 7/2002 | Eschenbach | 482/52 |
| 6,440,042 | B2 * | 8/2002 | Eschenbach | 482/52 |
| 7,201,706 | B1 | 4/2007 | Lee et al. | |
| 7,223,209 | B2 | 5/2007 | Lee | |
| 7,448,986 | B1 * | 11/2008 | Porth | 482/52 |
| 7,462,135 | B2 * | 12/2008 | Lo | 482/52 |
| 7,618,350 | B2 * | 11/2009 | Dalebout et al. | 482/52 |
| 7,727,120 | B2 * | 6/2010 | Smith | 482/52 |
| 7,806,808 | B2 * | 10/2010 | Kuo | 482/52 |
| 2007/0087907 | A1 * | 4/2007 | Rodgers | 482/52 |

* cited by examiner

*Primary Examiner* — Oren Ginsberg
(74) *Attorney, Agent, or Firm* — Rajesh Vallabh; Foley Hoag LLP

(57) ABSTRACT

An exercising device includes left and right linking units each having a swing link pivotally mounted on a front support of a frame, a crank link coupling a crank arm to the swing link, and a pedal link connected to a lower end of the swing link, and left and right foot engaging pedals each mounted on a rear linkage end of the pedal link to be movable along an elliptical path with rotation of the crank arms. A sloping ramp member has an inclined surface to guide the foot engaging pedals to simulate stair climbing during the elliptical movement of the foot engaging pedals through left and right rollable anti-friction members mounted under the foot engaging pedals and rollably engaged with the inclined surface.

9 Claims, 7 Drawing Sheets

EXERCISING DEVICE

BACKGROUND OF THE INVENTION

1. Field of the Invention

This invention relates to an exercising device, more particularly to an exercising device which allows a user to perform an elliptical treading exercise that simulates stair climbing.

2. Description of the Related Art

Referring to FIG. 1, a conventional treadmill exercising device 1 is shown to include a frame 1 and a linking mechanism 2. The frame 1 has a front upright post 101, a rear bracing rod 102, a handle rod 103, and two upper transverse rods 104 and two lower transverse rods extending laterally from the front upright post 101. The linking mechanism 2 has two foot links 201 respectively and pivotably mounted on the lower transverse rods 105, two damper member 202 each mounted pivotably between a respective one of the upper transverse rods 104 and a respective one of the foot links 201, and an elastic cord 203 wound on the front upright post 101 and having two ends connected to the foot links 201, respectively, and two tread pads 204 disposed on rear ends of the foot links 201. When a user grips the handle rod 103 and treads on the tread pads 204, the foot links 201 will move pivotally about the lower transverse rod 105 to permit movement of the tread pads 204 along a constant arcuate path. Since the tread pads 204 move along a generally fixed arcuate path, the user can only training a certain muscle group of the body (such as the muscles of the lower limbs), and it is impossible for the user to use such conventional treadmill exercising device to train other muscle groups (such as the abdominal muscles).

Another conventional exercising device, such as those disclosed in U.S. Pat. Nos. 7,201,706 and 7,223,209 is an elliptical exercising machine used to simulate walking or running so as to train a user's upper and lower bodies.

SUMMARY OF THE INVENTION

An object of the present invention is to provide an exercising device which allows a user to perform an elliptical treading exercise that simulates stair climbing so as to train different muscle groups.

According to this invention, the exercising device includes a frame having base and front upper supports opposite to each other in an upright direction, left and right crank arms rotatably mounted on the frame, left and right linking units, each including a swing link pivotally mounted on the front upper support, a crank link coupling the respective crank arm to the swing link body, and a pedal link connected to a lower end of the respective swing link, and left and right foot engaging pedals respectively mounted on rear linkage ends of the pedal links such that, when a respective one of the left and right crank arms is driven to perform a rotational movement, a respective one of the left and right foot engaging pedals moves along an elliptical path.

The exercising device further includes a sloping ramp member disposed on the base support and having an inclined surface to guide the left and right foot engaging pedals during movement of the left and right foot engaging pedals along the elliptical path so as to simulate stair climbing, and left and right rollable anti-friction members, each mounted under a respective one of the left and right foot engaging pedals and rollably engaged with the inclined surface.

The sloping ramp member may be fixedly mounted on the frame, or adjustably mounted to the frame to be manually and electrically adjustable such that the inclination angle of the inclined surface is adjustable as required.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
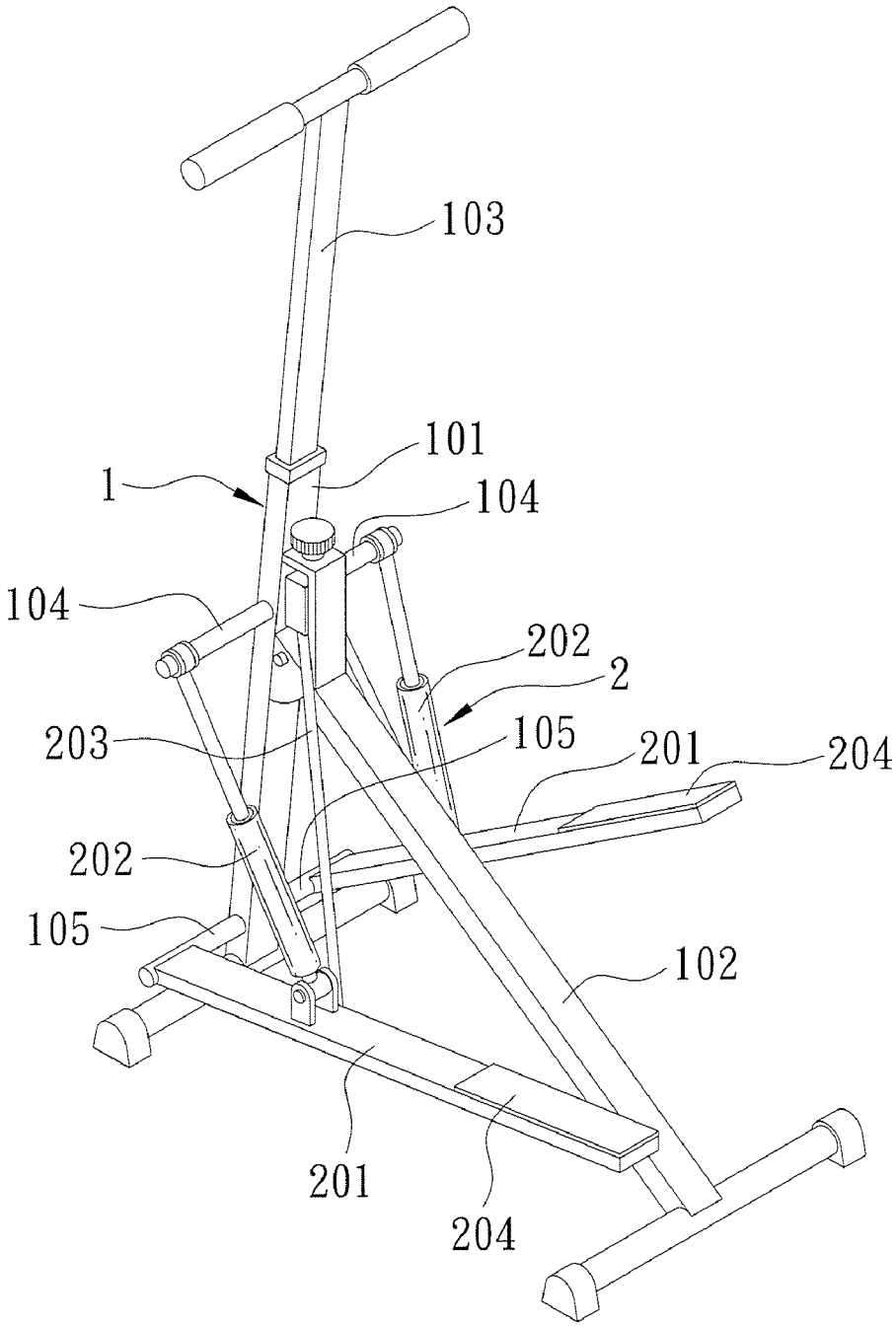
FIG. 1 PRIOR ART
FIG. 1 is a perspective view of a conventional treadmill exercising device.

Before the present invention is described in greater detail, it should be noted that same reference numerals have been used to denote like elements throughout the specification.

Figure 2:
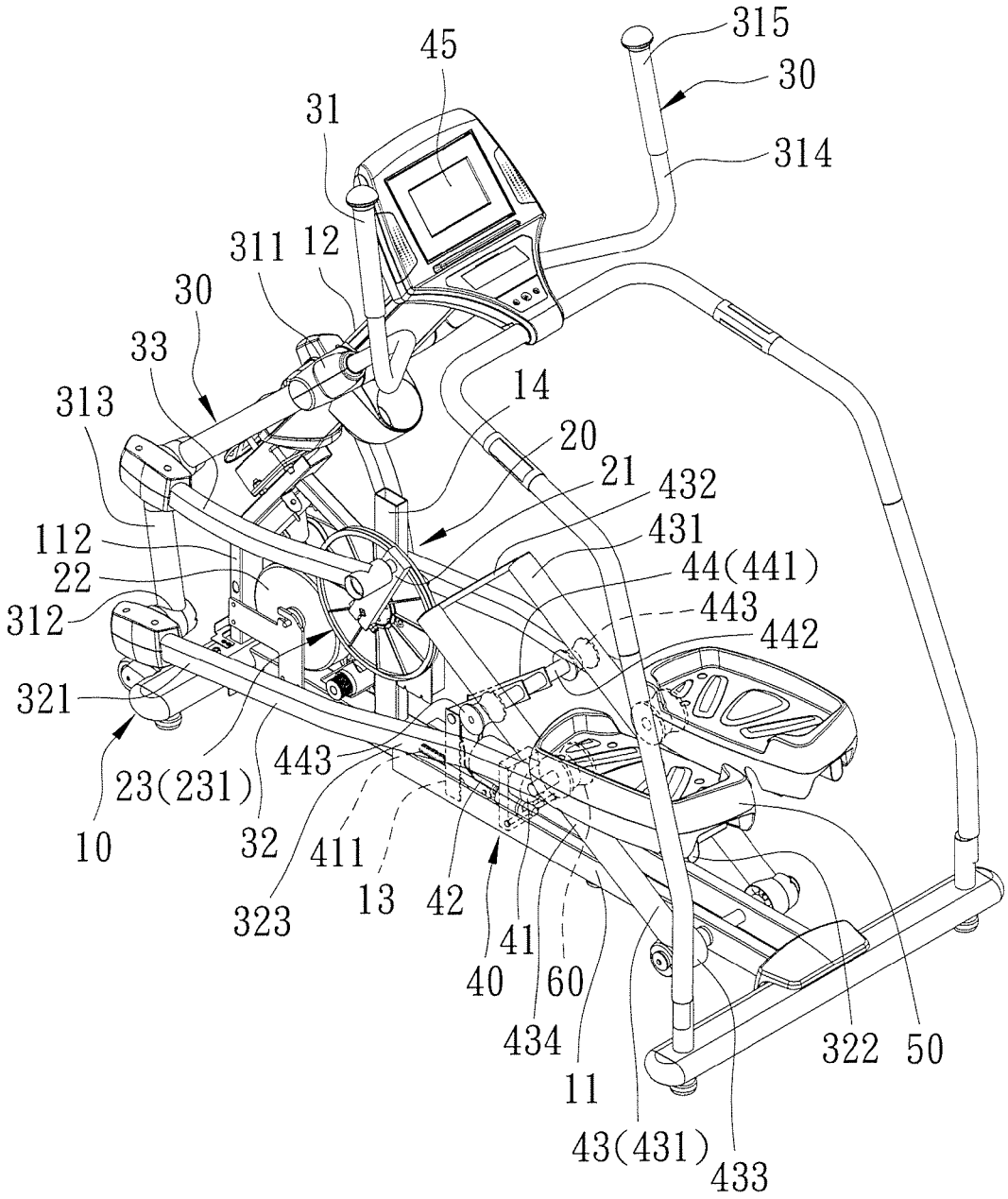
FIG. 2 is a perspective view of the first preferred embodiment of an exercising device according to this invention.
Figure 3:
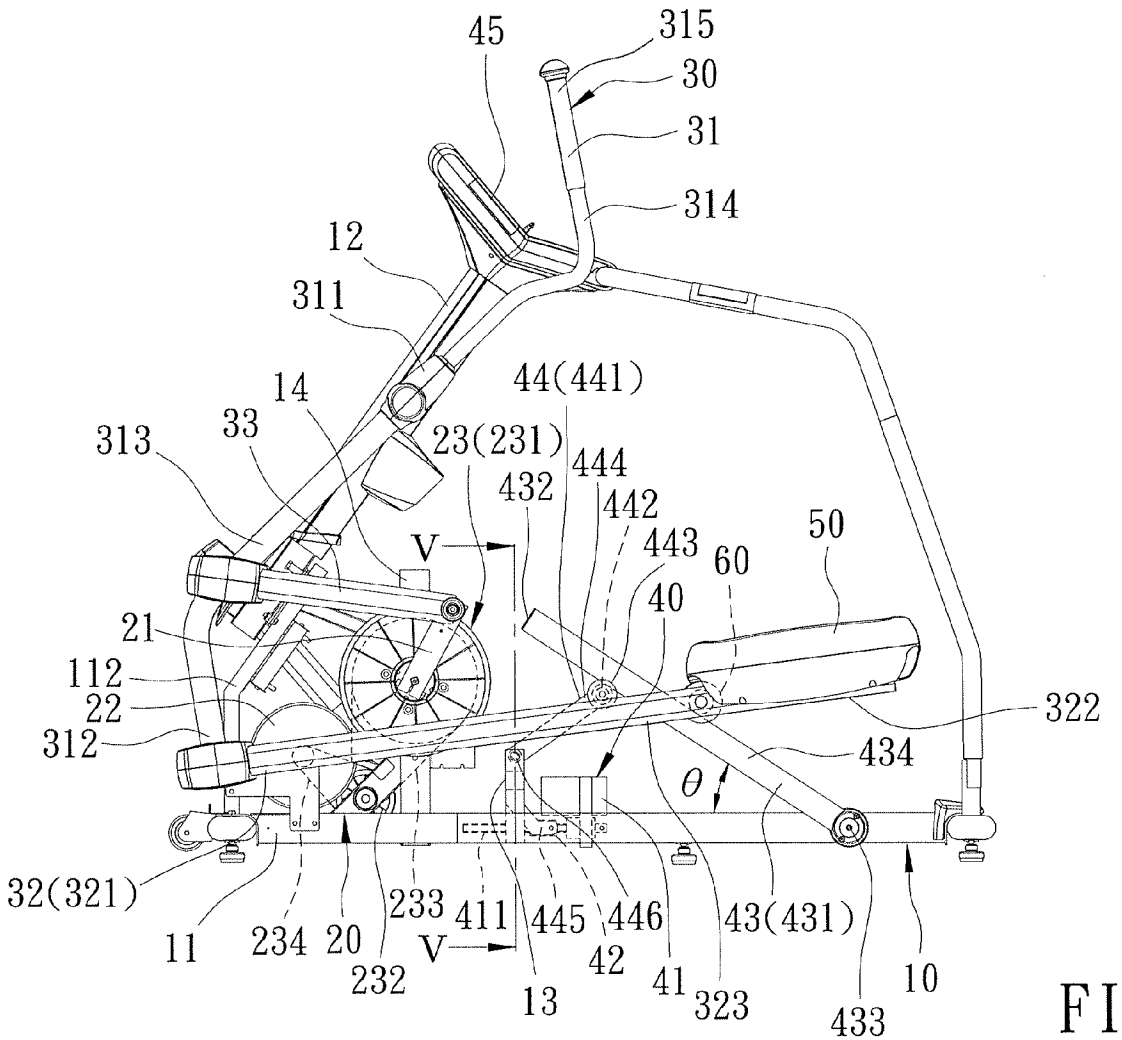
FIG. 3 is a left side view of the first preferred embodiment when a sloping ramp member is disposed at a largest inclination angle position.
Figure 4:
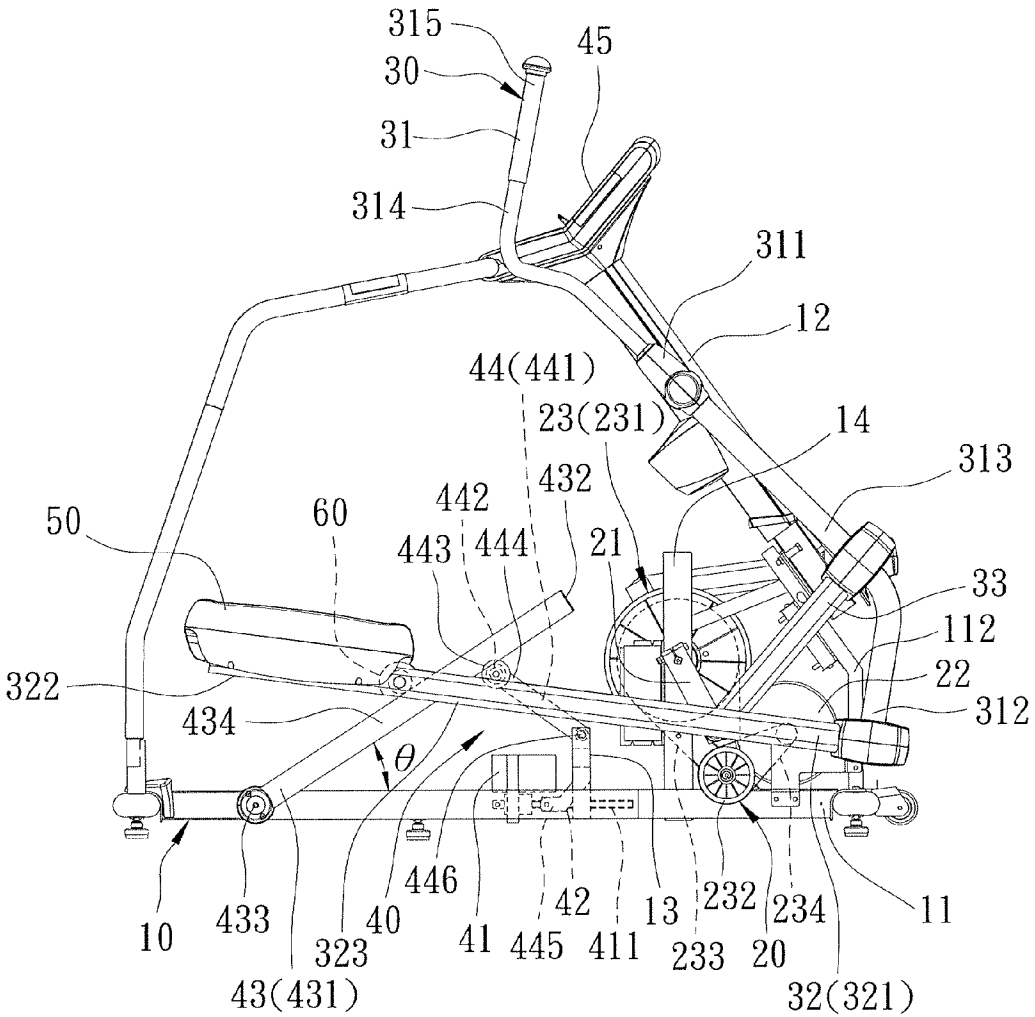
FIG. 4 is a right side view of the first preferred embodiment.

Referring to FIGS. 2 to 4, the first preferred embodiment of an exercising device according to the present invention is shown to comprise a frame 10, a momentum unit 20, left and right linking units 30, left and right foot engaging pedals 50, a ramp unit 40, and left and right rollable anti-friction members 60.

The frame 10 includes a base support 11, a front upper support 12 extending from a front portion 112 of the base support 11 in an upright direction, a crank support 14 disposed rearwardly of the front upper support 12, and a ramp support 13 disposed rearwardly of the crank support 14.

The momentum unit 20 includes left and right crank arms 21 coaxially and pivotally mounted on the crank support 14 to be rotatable about a crank axis that extends in a direction transverse to the upright direction, a flywheel 22 rotatably mounted on the base support 11 about a wheel axis parallel to the crank axis, and a transmitting mechanism 23 coupling the crank arms 21 with the flywheel 22. In this embodiment, the transmitting mechanism 23 includes a first pulley 231 coaxially mounted with the crank arms 21 about the wheel axis, a second pulley 232, a first belt 231 trained on the first and second pulleys 231, 232, and a second belt 234 trained on the second pulley 232 and the flywheel 22. Thus, the flywheel 22 is rotatable with the crank arms 21 to gain a momentum which facilitates movement of the crank arms 21 through any dead center positions.

The left and right linking units 30 are disposed respectively at two opposite sides of the frame 10 to perform alternate movements. Specifically, each linking unit 30 includes a swing link 31, a crank link 33, and a pedal link 32. The swing link 31 has an upper segment 311 pivotally mounted on the front upper support 12 about a pivot axis parallel to the crank axis, a swing link body 313 extending downwardly from the upper segment 311 to terminate at a lower end 312, and a handle 314 extending upwardly from the upper segment 311 to terminate at a handgrip 315. The crank link 33 is disposed to couple the respective crank arm 21 to the swing link body 313. The pedal link 32 has a front linkage end 321 connected to the lower end 312, and a pedal link body 323 extending rearwardly from the front linkage end 321 to terminate at a rear linkage end 322.

Each of the left and right foot engaging pedals 50 is mounted on the rear linkage end 322 of the respective pedal link 32. When the user grips the handgrips 315 to alternately swing the swing links 31 so as to drive alternately rotational movements of the crank arms 21 through the crank links 33, the foot engaging pedals 50 are brought to move along an elliptical path.

Figure 5:
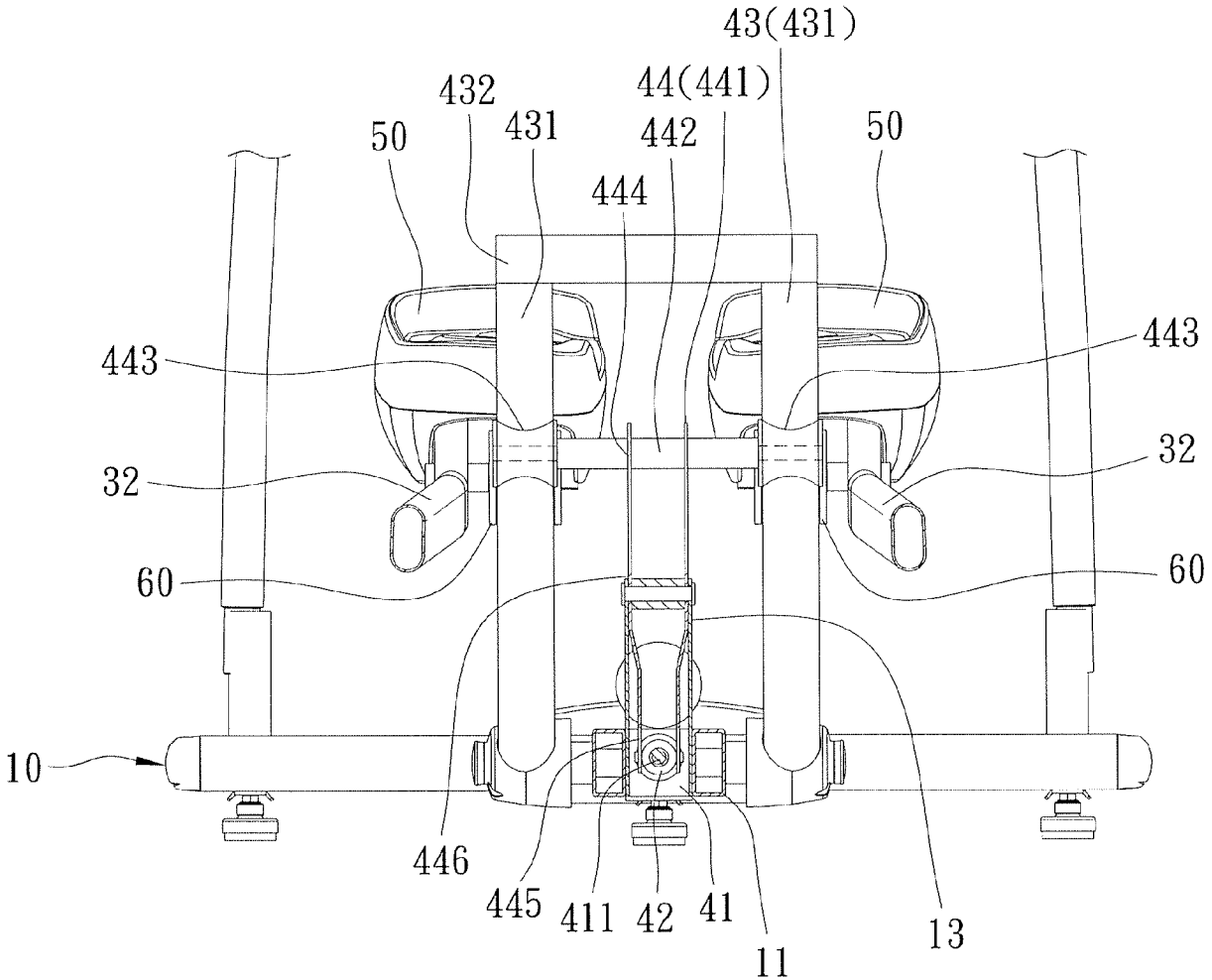
FIG. 5 is a sectional view taken along line V-V of FIG. 3.

With reference to FIGS. 2, 3 and 5, the ramp unit 40 includes a sloping ramp member 43 which has left and right ramp rods 431 and a cross piece 432 interconnecting the left and right ramp rods 431. Each ramp rod 431 has a rear rod end 433 pivotally mounted on the base support 11, and a ramp rod body 434 extending upwardly and forwardly from the rear rod end 433 to terminate at a front rod end connected to the crosspiece 432, and serving as an inclined surface. Each of the left and right rollable anti-friction members 60 is mounted under the respective foot engaging pedal 50 and is rollably engaged with the respective ramp rod body 434. During movement of the left and right foot engaging pedals 50 along the elliptical path, the left and right foot engaging pedals 50 are guided by the respective ramp rod bodies 434 to simulate stair climbing.

Figure 6:
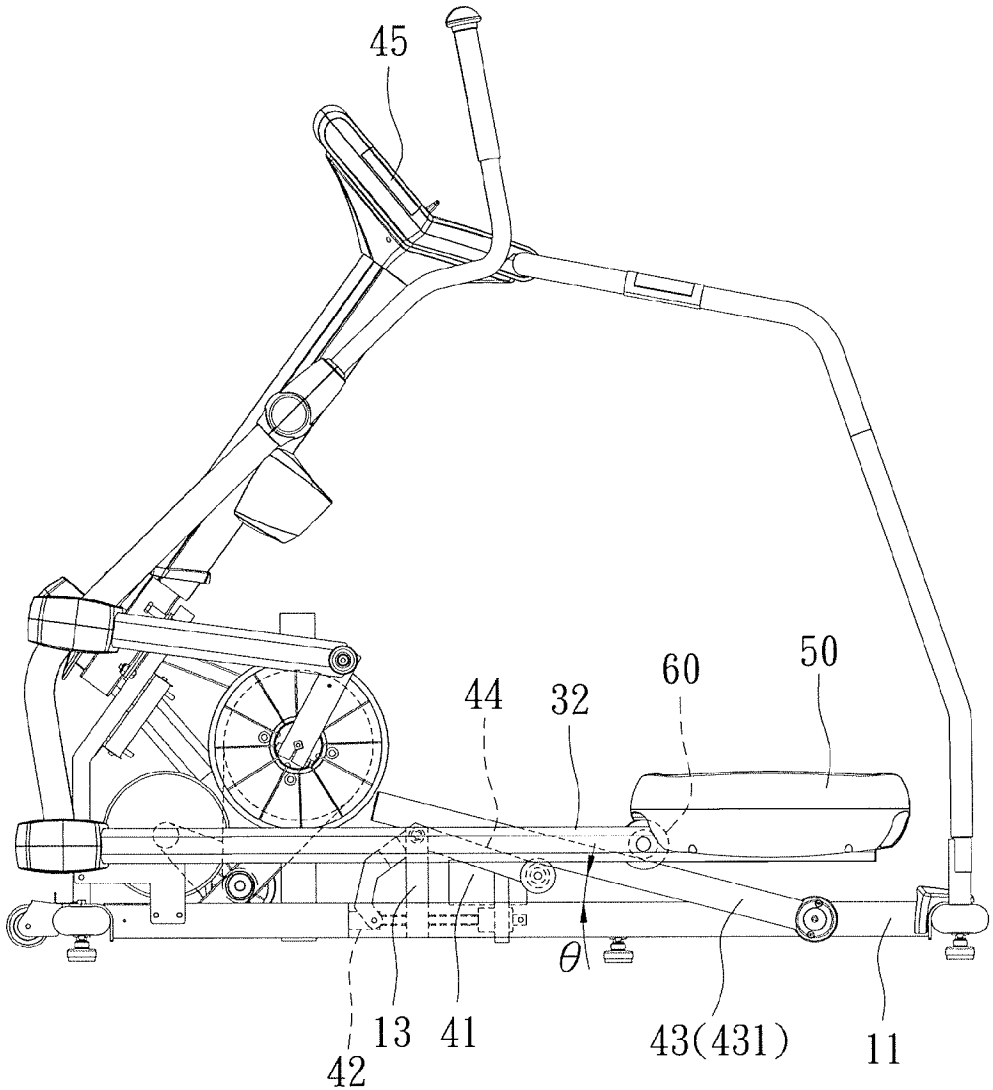
FIG. 6 is a view similar to FIG. 3 but illustrating the sloping ramp member disposed at a smallest inclination angle position.

In this embodiment, the ramp unit 40 further includes an electric drive unit, such as a servomotor 41, mounted on the base support 11 and having an output shaft 411 which extends in a longitudinal direction and which has an externally threaded portion, and a lever 44 in the form of a frame body 441 which has a weight end 444, a power end 445, and a fulcrum 446 journalled on the ramp support 13. The weight end 444 has left and right anti-friction rollers 443 pivotally disposed on a cross piece 442 on the frame body 441 and respectively and rollably engaged with the left and right ramp rod bodies 434. The power end 445 has an internally threaded portion 42 which is in the form of a screw nut 42 and which is threadedly engaged with the externally threaded portion of the output shaft 411. With the engagement between the screw nut 42 and the output shaft 411, rotation of the output shaft 411 results in a longitudinal movement of the power end 445 to turn the weight end 444 about the fulcrum 446 so as to vary a height position of the weight end 444, thereby adjusting an inclination angle (θ) of the left and right ramp rods 431. FIG. 3 illustrates the first preferred embodiment when the inclination angle (θ) of each of the left and right ramp rods 431 is the largest. At this stage, the foot engaging pedals 50 can simulate stair climbing with a relatively large slope. FIG. 6 illustrates the first preferred embodiment when the inclination angle (θ) of each of the left and right ramp rods 431 is the smallest. At this stage, the foot engaging pedals 50 can simulate stair climbing with a relatively small slope. A control panel 45 is mounted on the front upper support 12 and is electrically connected to the servomotor 41 to be operable to control the servomotor 41.

With arrangement of the sloping ramp member 43 that guides movement of the foot engaging pedals 50 to simulate stair climbing when the foot engaging pedals 50 are moved along the elliptical path, the user is able to perform treading and climbing exercises as well as arm exercises to train his/her different muscle groups. Besides, due to the sloping ramp member 43 that can be adjusted to a desired slope as required, the user can train his/her muscles at different levels.

Figure 7:
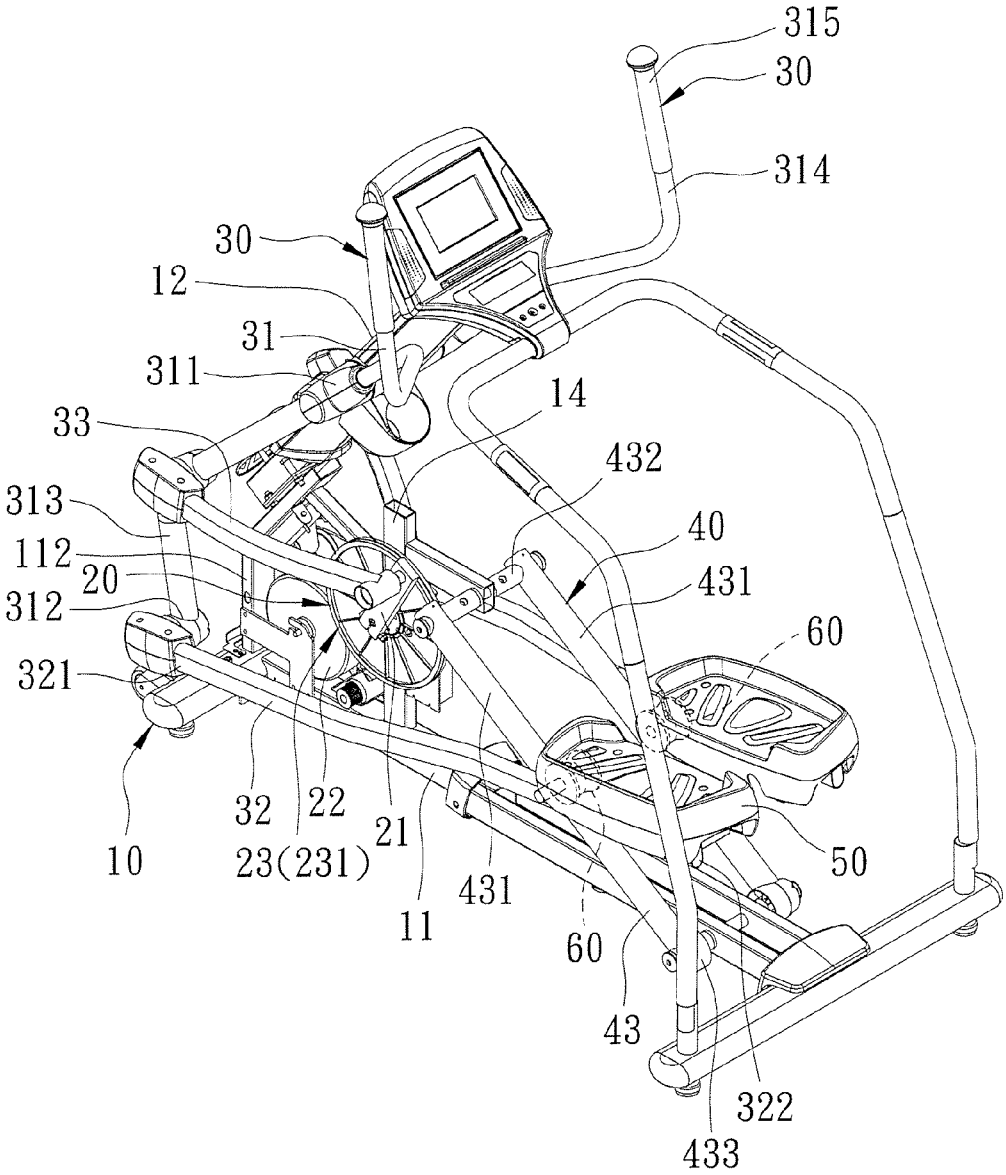
FIG. 7 is a perspective view of the second preferred embodiment of an exercising device according to this invention.

As shown in FIG. 7, the second preferred embodiment of an exercising device according to this invention is shown to be similar to the first embodiment. In this embodiment, to simplify the structure thereof, the front rod ends of the left and right ramp rods 431 are securely connected to the ramp support 13. It is noted that the front rod ends of the left and right ramp rods 431 may also be adjustably mounted on the ramp support 13 in a known manner to be manually adjusted to the desired height position.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. An exercising device comprising:

a frame including base and front upper supports opposite to each other in an upright direction;

left and right crank arms mounted on said frame and rotatable about a crank axis that extends in a direction transverse to said upright direction;

left and right linking units, each including a swing link which has an upper segment that is pivotally mounted on said front upper support about a pivot axis parallel to the crank axis, and a swing link body that extends downward from said upper segment to terminate at a lower end, a crank link configured to couple a respective one of said left and right crank arms to said swing link body, wherein each crank link has a first end directly coupled to said respective one of said left and right crank arms and a second opposite end directly coupled to a respective one of said swing link bodies, and a pedal link having a front linkage end connected to said lower end, and a pedal link body which extends rearwardly from said front linkage end to terminate at a rear linkage end, wherein said swing link of each of said left and right linking units includes a handle which extends upwardly from said upper segment to terminate at a handgrip which is manually operable to alternately swing said swing links of said left and right linking units so as to drive rotational movement of said left and right crank arms through said crank links;

left and right foot engaging pedals respectively mounted on said rear linkage ends of said left and right linking units such that, when a respective one of said left and right crank arms is driven to perform a rotational movement, a respective one of said left and right foot engaging pedals moves along an elliptical path;

a sloping ramp member which is disposed on said base support and rearwardly of said left and right crank arms, and which has an inclined surface to guide said left and right foot engaging pedals during movement of said left and right foot engaging pedals along the elliptical path so as to simulate stair climbing, wherein the inclination of the sloping ramp member is adjustable by an electric drive unit; and left and right rollable anti-friction members, each mounted under a respective one of said left and right foot engaging pedals and rollably engaged with said inclined surface.

2. The exercising device according to claim 1, wherein said sloping ramp member includes left and right ramp rods, each having a rear rod end pivotally mounted on said base support, and a ramp rod body extending upwardly and forwardly from said rear rod end to terminate at a front rod end, and serving as said inclined surface.

3. The exercising device according to claim 2, wherein said frame includes a crank support disposed rearwardly of said front upper support to permit said left and right crank arms to be pivotally mounted on said crank support, and a ramp support disposed rearwardly of said crank support to support said front rod ends of said left and right ramp rods.

4. The exercising device according to claim 3, further comprising a lever having a weight end which is disposed to support and to be in slidable engagement with said ramp rod bodies, a power end which is disposed opposite to said weight end and which is driven by the electric drive unit to move in a longitudinal direction, and a fulcrum which is journalled on said ramp support such that, as a result of a longitudinal movement of said power end, said weight end is turnable about said fulcrum to vary a height position of said weight end so as to adjust inclination of said left and right ramp rods.

5. The exercising device according to claim 3, wherein said front rod ends of said left and right ramp rods are securely connected to said ramp support.

6. The exercising device according to claim 4, wherein said electric drive unit is a servomotor having an output shaft extending in the longitudinal direction and having an externally threaded portion, said power end of said lever having an internally threaded portion which is threadedly engaged with said externally threaded portion such that rotation of said output shaft results in the longitudinal movement of said power end.

7. The exercising device according to claim 4, wherein said weight end of said lever has left and right anti-friction rollers respectively and rollably engaged with said left and right ramp rod bodies.

8. The exercising device according to claim 6, further comprising a control panel which is mounted on said front upper support and which is electrically connected to said servomotor.

9. The exercising device according to claim 1, further comprising a flywheel rotatably mounted on said frame about a wheel axis parallel to the crank axis; and a transmitting mechanism coupling said left and right crank arms with said flywheel such that said flywheel is rotatable with said left and right crank arms to gain a momentum which facilitates movement of said left and right crank arms through any dead center positions.

* * * * *